US008083305B2

(12) United States Patent
Lee et al.

(10) Patent No.: US 8,083,305 B2
(45) Date of Patent: Dec. 27, 2011

(54) SEALING STRUCTURE OF REFRIGERATOR

(75) Inventors: Jeong Youl Lee, Changwon-si (KR); Sang Bae Kim, Changwon-si (KR); Suk Hyoun Cho, Changwon-si (KR)

(73) Assignee: LG Electronics Inc., Seoul (KR)

( * ) Notice: Subject to any disclaimer, the term of this patent is extended or adjusted under 35 U.S.C. 154(b) by 824 days.

(21) Appl. No.: 11/910,667

(22) PCT Filed: Apr. 7, 2006

(86) PCT No.: PCT/KR2006/001276
§ 371 (c)(1),
(2), (4) Date: Jun. 23, 2008

(87) PCT Pub. No.: WO2006/107180
PCT Pub. Date: Oct. 12, 2006

(65) Prior Publication Data

US 2008/0263963 A1 Oct. 30, 2008

(30) Foreign Application Priority Data

Apr. 8, 2005 (KR) ..... 10-2005-0029425
Apr. 8, 2005 (KR) ..... 10-2005-0029429
Apr. 8, 2005 (KR) ..... 10-2005-0029430
Apr. 21, 2005 (KR) ..... 10-2005-0033278

(51) Int. Cl.
*A47B 96/04* (2006.01)

(52) U.S. Cl. ..... 312/405; 312/296

(58) Field of Classification Search ..... 312/405, 312/296, 326–329; 49/475.1, 478.1, 484.1, 49/498.1; 277/644–646, 648, 921; 62/404, 62/440
See application file for complete search history.

(56) References Cited

U.S. PATENT DOCUMENTS 2,190,954 A * 2/1940 Stickel ..... 220/592.06
2,591,003 A * 4/1952 Philipp ..... 49/484.1
2,949,651 A * 8/1960 Hill ..... 49/493.1
3,378,958 A * 4/1968 Parks et al. ..... 49/489.1
4,469,383 A * 9/1984 Losert ..... 312/296
4,617,759 A * 10/1986 Pasqualini et al. ..... 49/478.1
4,653,819 A 3/1987 Swerbinsky
(Continued)

FOREIGN PATENT DOCUMENTS

EP 0 583 983 A1 2/1994
(Continued)

OTHER PUBLICATIONS

Translation of JP-10-259983-A, publication date Sep. 29, 1998.*

*Primary Examiner* — Darnell Jayne
*Assistant Examiner* — Hiwot Tefera
(74) *Attorney, Agent, or Firm* — Birch, Stewart, Kolasch & Birch, LLP

(57) ABSTRACT

A refrigerator is provided, by which cold air can be effectively prevented from leaking from a storage room. The refrigerator includes a refrigerator body having an opening and a storage room provided therein, a door closing/opening, a sealing part provided to at least one of the door and the refrigerator body to prevent a cold air from leaking from the storage room, and a flow cutoff part provided inside the sealing part to prevent the cold air flowing toward the sealing part from the storage room. Accordingly, by cutting of the cold air leakage together with the sealing part, energy efficiency of the refrigerator can be raised.

12 Claims, 9 Drawing Sheets

U.S. PATENT DOCUMENTS

| | | | | |
|---|---|---|---|---|
| 4,742,646 | A * | 5/1988 | Kehrli | 49/479.1 |
| 4,916,864 | A * | 4/1990 | Thompson | 49/478.1 |
| 5,269,099 | A * | 12/1993 | Kennedy et al. | 49/484.1 |
| 5,289,657 | A * | 3/1994 | Kiel | 49/478.1 |
| 5,487,239 | A * | 1/1996 | Jenkins et al. | 49/498.1 |
| 5,533,311 | A * | 7/1996 | Tirrell et al. | 52/309.9 |
| 5,551,192 | A * | 9/1996 | Avendano et al. | 49/484.1 |
| 6,227,634 | B1 * | 5/2001 | Cittadini et al. | 312/296 |
| 6,802,666 | B1 * | 10/2004 | Bormann et al. | 403/233 |
| 7,008,032 | B2 * | 3/2006 | Chekal et al. | 312/405 |
| 7,066,473 | B2 * | 6/2006 | Arata et al. | 277/652 |
| 7,147,292 | B2 * | 12/2006 | Lee et al. | 312/296 |
| 7,204,568 | B2 * | 4/2007 | Lim et al. | 312/296 |
| 2004/0051427 | A1 * | 3/2004 | Cittadini et al. | 312/296 |
| 2005/0046319 | A1 * | 3/2005 | Chekal et al. | 312/401 |
| 2006/0080995 | A1 * | 4/2006 | An | 62/441 |
| 2007/0216272 | A1 * | 9/2007 | Park | 312/405 |
| 2008/0276540 | A1 * | 11/2008 | Kim | 49/478.1 |
| 2009/0039751 | A1 * | 2/2009 | Keller et al. | 312/405 |
| 2009/0058246 | A1 * | 3/2009 | Cittadini et al. | 312/405 |
| 2009/0179540 | A1 * | 7/2009 | Seo | 312/405 |
| 2009/0184615 | A1 * | 7/2009 | Casoli | 312/405 |
| 2009/0241585 | A1 * | 10/2009 | Diebold et al. | 62/406 |
| 2009/0243453 | A1 * | 10/2009 | Kang et al. | 312/405 |
| 2010/0307065 | A1 * | 12/2010 | Eckartsberg | 49/475.1 |

FOREIGN PATENT DOCUMENTS

| | | | |
|---|---|---|---|
| JP | 10-259983 | A | 9/1998 |
| KR | 10-1999-0042588 | A | 6/1999 |
| KR | 2000-0007351 | U | 4/2000 |

* cited by examiner

[Fig. 6]
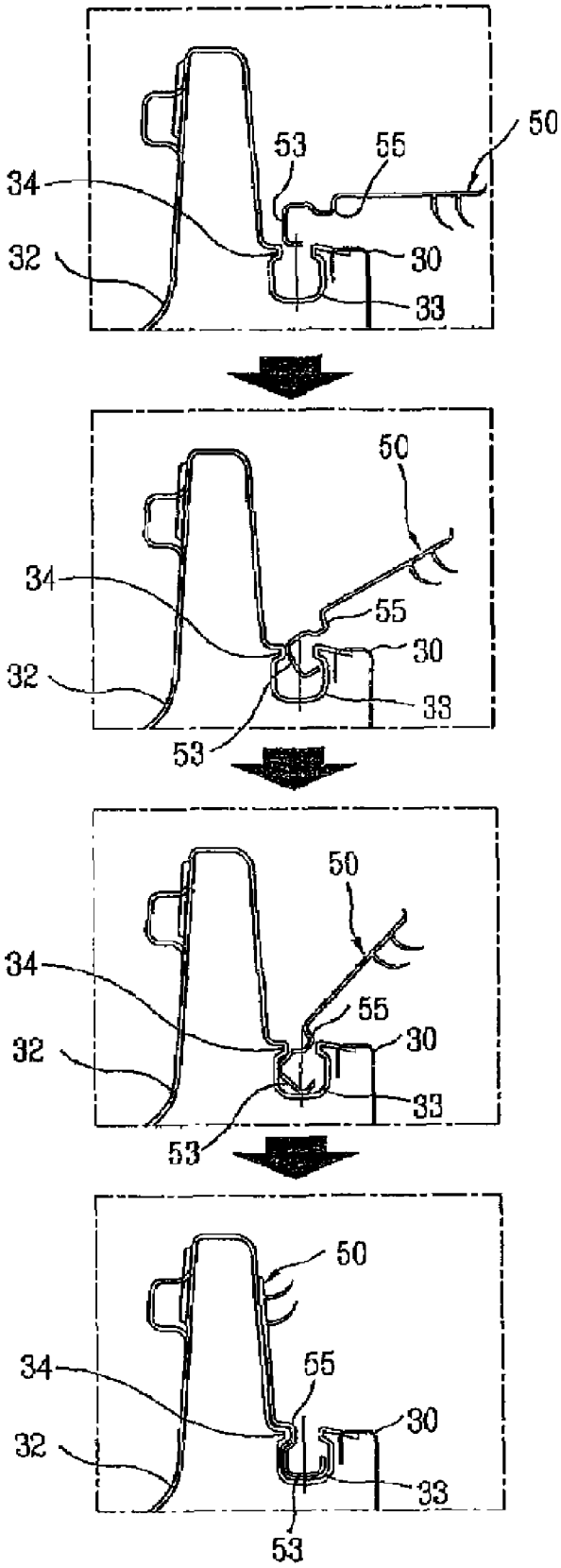

[Fig. 7]
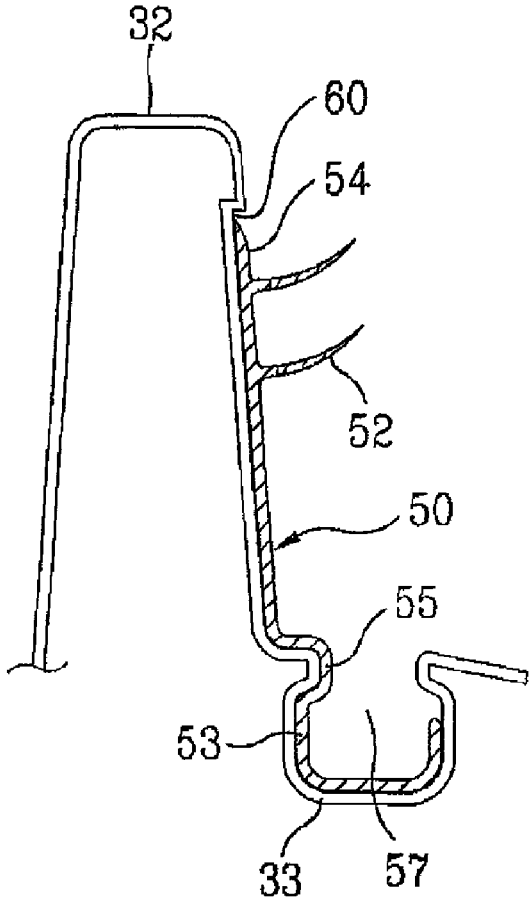
[Fig. 8]
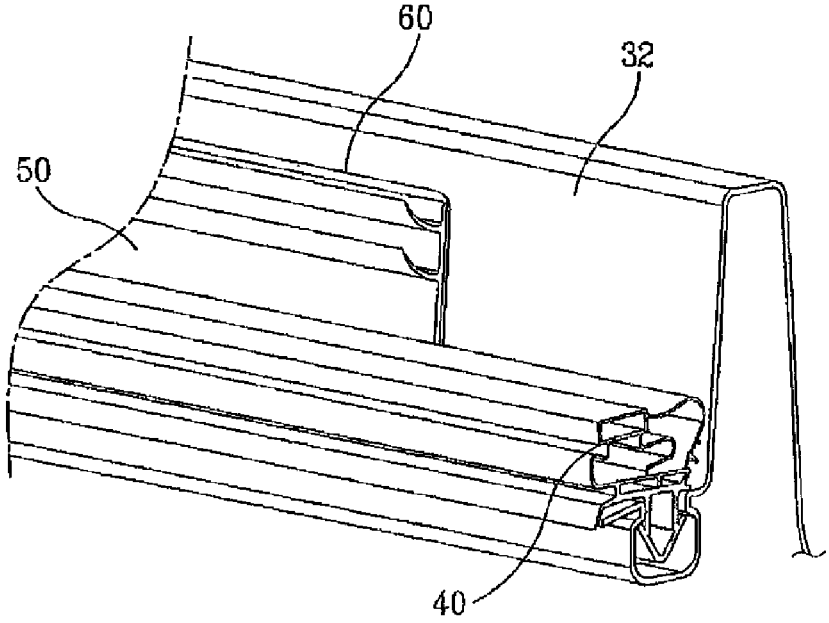

[Fig. 11]

SEALING STRUCTURE OF REFRIGERATOR

TECHNICAL FIELD

The present invention relates to a refrigerator. Although the present invention is suitable for a wide scope of applications, it is particularly suitable for preventing cold air leakage from a storage room by improving a structure of the refrigerator.

BACKGROUND ART

Generally, a refrigerator is provided with a plurality of storage rooms such as a freezer room for storing frozen food or beverage, a cold storage room for storing food or beverage at a low temperature and the like.

The storage room is configured to have an opening at its one side to enable a user to put food in the storage room or to take out the food put therein. The opening is generally closed by a door rotatably mounted to the refrigerator body.

The door and the storage room are formed of a metal or resin based material in general. It can be difficult to provide airtightness between the door and the opening of the storage room, depending on the characteristics of the door and the storage room.

A microscopic gap may exist between the door and the opening, so that cold air within the storage room leaks out of the refrigerator.

To prevent such cold air leakage, a refrigerator according to the related art has a sealing member formed of an elastic material provided at a contact area between the door and the opening, to block a gap between the door and the opening.

The sealing part is provided at a contact area between the door and the opening of the storage room, and more particularly, to an inner edge of the door to have a prescribed thickness. The sealing part is generally formed of a rubber based elastic material to adhere closely to the inner edge of the door and an outer boundary of the opening.

If the opening of the storage room is closed, the sealing part provided to the inner edge of the door comes into contact with the outer boundary of the opening to adhere closely thereto. So, the sealing part contacts with the outer boundary of the opening of the storage room to seal the door and the opening.

Yet, even if the opening is sealed using the sealing part, the contact area between the sealing part and the outer boundary of the opening can fail to be completely airtight, with but a microscopic gap being generated at the contact area, so that a cold air leaks from the storage room.

To solve this problem, an auxiliary member such as a magnet or similar, for enhancing an adherence between the sealing part and the opening has been developed to enable the sealing part and the outer boundary of the opening to adhere more closely to each other. Yet, the complete airtightness of the opening can still be difficult to achieve due to an aging of the sealing part, deformation of the rubber-based sealing part due to adherence between the door and the opening, and the like.

Moreover, if the sealing part is cooled down by the cold air of the storage room, water drops may form on an outer surface of the sealing part to the dissatisfaction of a consumer.

DISCLOSURE OF INVENTION

Technical Problem

Accordingly, the present invention is directed to a refrigerator that addresses one or more of the problems due to limitations and disadvantages of the related art.

It would be desirable to provide a refrigerator, by which cold air leakage from a storage room can be reduced.

It would also be desirable to provide a refrigerator, by which user's convenience is enhanced by preventing water drop formation.

Technical Solution

To achieve these and other advantages and in accordance with the purpose of the present invention, as embodied and broadly described, a refrigerator according to the present invention includes a refrigerator body having an opening and a storage room provided therein, a door closing/opening the opening, a sealing part provided to at least one of the door and the refrigerator body to prevent cold air from leaking out of the storage room, and a flow cutoff part provided inwards from the sealing part to further prevent the cold air from leaking by blocking at least some of the cold air flowing toward the sealing part from the storage room, the flow cutoff part comprising a rib projected outwardly towards an inner lateral side of the storage room, and a tip of the rib being spaced apart from the inner lateral side of the storage room.

Preferably, the rib is configured convex toward the storage room with a prescribed curvature. More preferably, the rib is elongate. More preferably, the rib comprises a plurality of rib members arranged to be spaced apart from each other.

Preferably, the flow cutoff part is detachably provided to an inner lateral side of the door.

More preferably, the flow cutoff part is provided to an inner lateral side of the door and a tip of the rib is spaced apart from an inner lateral side of the storage room.

More preferably, the flow cutoff part is provided to an inner lateral side of the door.

More preferably, the flow cutoff part further comprises a fixing portion having a shape corresponding to, and adapted for fitting into a fixing groove provided to the inner lateral side of the door. More preferably, an insertion groove having one open side is provided to the fixing portion to enable the sealing part to be fitted into the insertion groove while the fixing portion is fitted into the fixing groove. More preferably, the sealing part comprises a fixing protrusion to be fitted into the insertion groove provided to the flow cutoff part. More preferably, the flow cutoff part further comprises a support portion having a shape corresponding to a hanging sill provided to an entrance side of the fixing groove.

More preferably, the flow cutoff part further comprises a tilted portion provided to a tip of the flow cutoff part to be tilted in a direction opposite to a direction that the rib is projected.

More preferably, a body of the flow cutoff part provided with at least one rib is farther tilted toward the inner lateral side of the door such that it is pressed against the inner lateral side of the door when fitted.

Preferably, a recessed portion is provided to at least one of an inner lateral side of the door and an inner lateral side of the storage room to accommodate the flow cutoff part.

Preferably, the sealing part and the flow cutoff part are built in one body.

The flow cutoff part can be attached to an inner lateral side of the door by a prescribed adhesive agent.

ADVANTAGEOUS EFFECTS

A refrigerator according to the present invention provides the following effects or advantages.

First of all, by providing a flow cutoff part cutting cold air flowing toward a sealing part from a storage room, cold air leakage can be doubly cut off together with the sealing part to enhance energy efficiency of the refrigerator.

In particular, a plurality of outwardly projected rib members are arranged to be spaced apart from each other, whereby a flow of cold air can be effectively cut off.

Secondly, by cutting off cold air flowing toward a sealing part, water droplets are not formed on a door and an outer boundary of a front side of a storage room, thereby enhancing a user's convenience.

Thirdly, by preventing food remainders and beverage from being introduced together with cold air flowing toward a sealing part, a door provided with the sealing part can be kept cleaner.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 6 is a cross-sectional diagram of a flow cutoff part and a door for explaining a process of assembling the flow cutoff part to the door;

FIG. 7 is a cross-sectional diagram of a door and a flow cutoff part of a refrigerator according to a second embodiment of the present invention, in which a fixed state of the door and flow cutoff part is shown;

FIG. 8 is a perspective diagram of a door according to a second embodiment of the present invention;

BEST MODE OF CARRYING OUT THE INVENTION

Reference will now be made in detail to the preferred embodiments of the present invention, examples of which are illustrated in the accompanying drawings.

A basic configuration of a refrigerator according to a first embodiment of the present invention is explained with reference to FIGS. 1 to 3 as follows.

Figure 1:
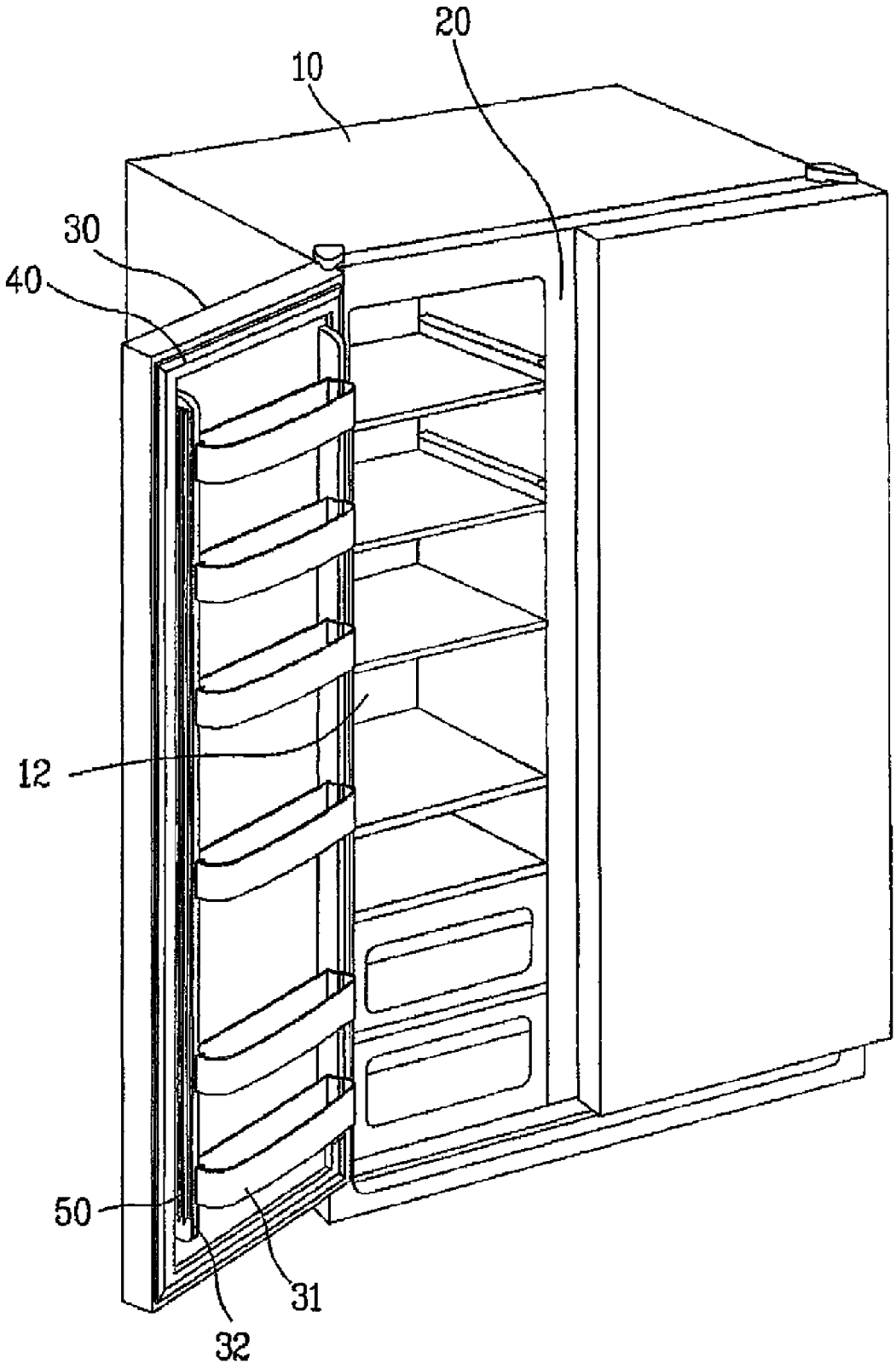
FIG. 1 is a perspective diagram of a refrigerator according to a first embodiment of the present invention.
Figure 2:
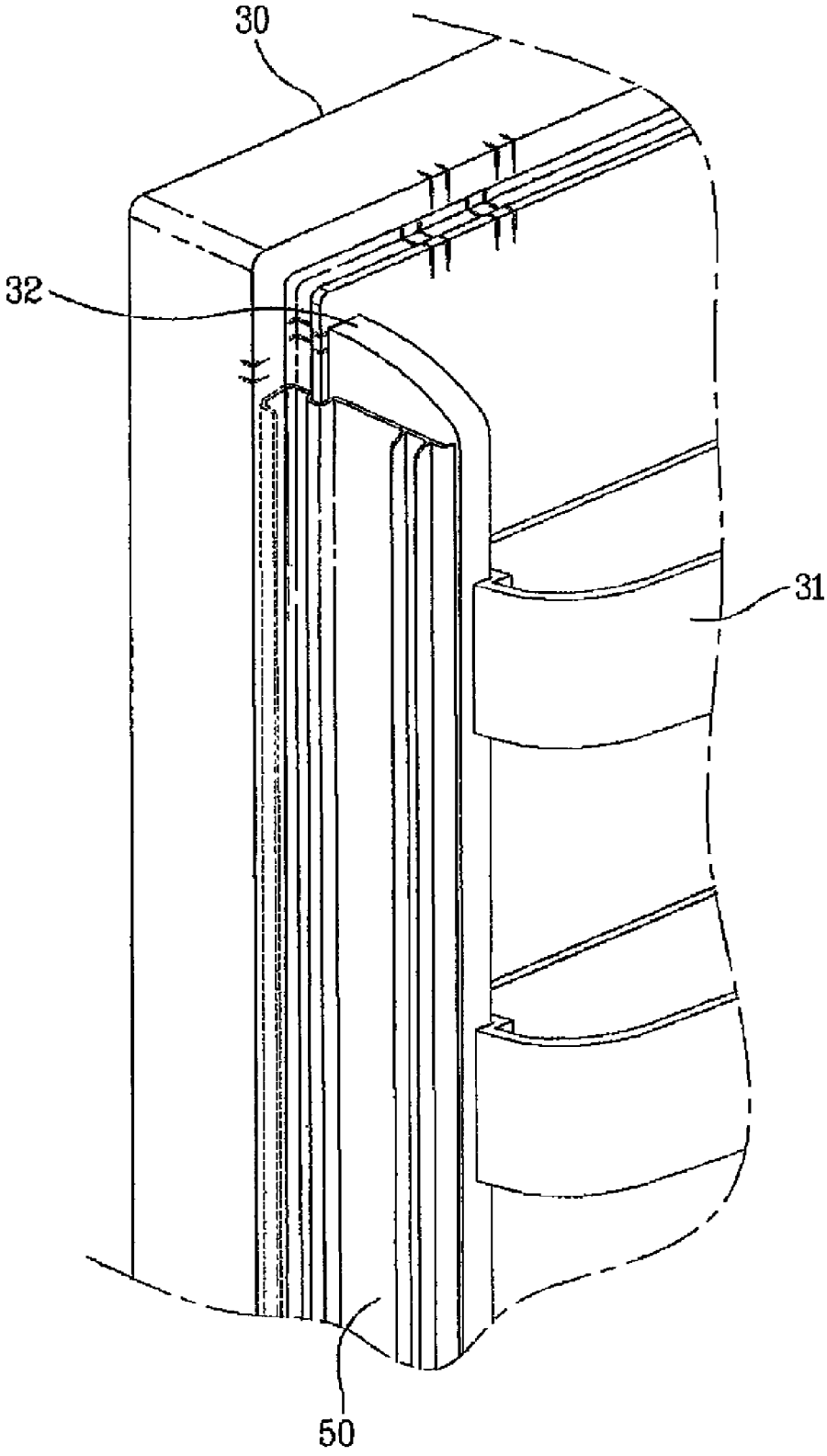
FIG. 2 is a perspective diagram of a door shown in FIG. 1.
Figure 3:
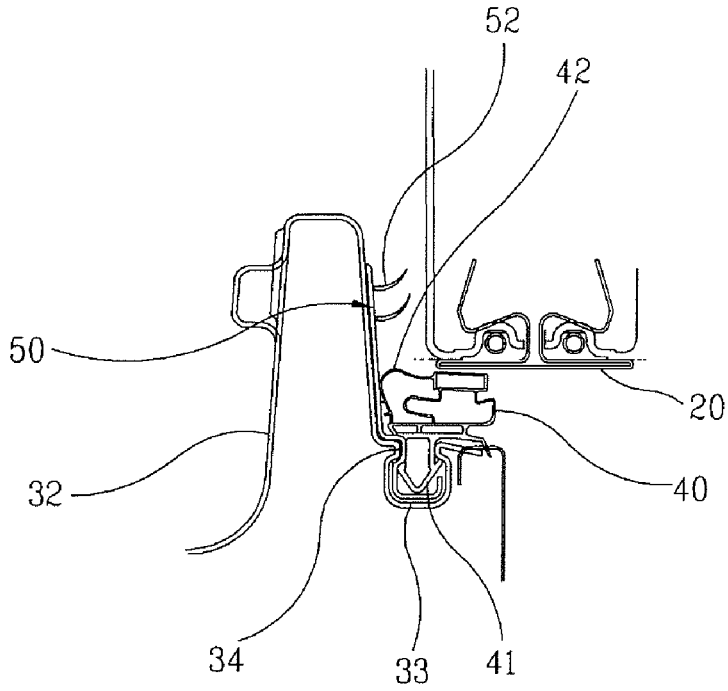
FIG. 3 is a cross-sectional diagram of a contact area of a door of FIG. 1 in a closed state.

Referring to FIGS. 1 to 3, a refrigerator according to a first embodiment of the present invention basically includes a refrigerator body 10, a door 30, a sealing part 40 and a flow cutoff part 50.

The refrigerator body 10 includes a storage room 12 inside. An opening (no reference number is given) is generally provided to one side of the storage room 12 of the refrigerator body 10 to enable an accommodation of food. In the present embodiment, the opening is provided to a front side of the storage room 12 for example.

Multiple storage rooms 12 can be arranged in a vertical or horizontal direction. A barrier 20 having a partition wall shape is provided as a boundary between the storage rooms 12. In the present embodiment, the respective storage rooms 12 of the refrigerator are arranged in the horizontal direction and the barrier 20 is provided as the boundary between the storage rooms 12.

The door 30 closes or opens the opening provided to the refrigerator body 10. The door 30 is rotatably assembled to the refrigerator body 10 via a hinge provided to a side end of each of the storage rooms 12 in general.

At least one basket 31 is provided to an inner lateral side of the door 20 to enable an accommodation of beverage containers and the like. The at least one basket 31, as shown in FIG. 1, has a box shape of which topside is open. And, a plurality of the baskets 31 is arranged in the vertical direction on a plurality of positions of the inner lateral side of the door 30, respectively.

For the assembly and hanging of the basket 31 provided to the inner lateral side of the door 30, a dike 32 having a barrier shape is provided to both sides of the inner lateral side of the door 30 to be projected inward.

The sealing part 40 is provided to at least one of the door 30 and the refrigerator body 10. And, the sealing part 40 performs a function of preventing cold air from leaking from the corresponding storage room 12.

The sealing part 40, as shown in FIG. 2 and FIG. 3, is provided to edges of the inner lateral side of the door 30 to adhere thereto. If the door is closed 30, the sealing part 40 adheres closely to a front side of the barrier 20.

The sealing part 40 has a hollow shape and is preferably formed of an elastic rubber based material.

The sealing part 40 is installed by fitting a fixing protrusion 41 into a fixing groove 33 formed on the inner lateral side of the door 30. In this case, the fitting groove 33 is recessed inward along the edge of the inner lateral side of the door 30, and more specifically, along an outer side of the dike 32.

The fixing protrusion 41 provided to the sealing part 40 is also fitted into an insertion groove 57 of the flow cutting part 50 to fix the sealing part 40 to the inner lateral side of the door 30. The fixing protrusion 41, as shown in FIG. 3, has a cross-sectional shape of an arrowhead and is directed into the inner lateral side of the door 30. The fixing protrusion 41 is preferably built in one piece with the sealing part 40.

The flow cutoff part 50 is provided inwards of the sealing part 40. The flow cutoff part 50 plays a role in preventing cold air leakage together with the sealing part 40 by cutting off at least some of the cold air flowing towards the sealing part 40 from the corresponding storage room 12.

A detailed configuration of the flow cutoff part 50 is explained with reference to FIG. 4 and FIG. 5 as follows.

Figure 4:
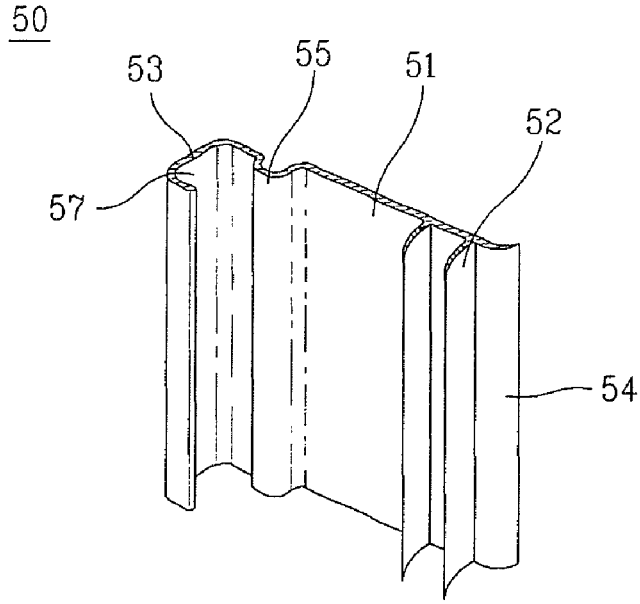
FIG. 4 is a perspective diagram of a flow cutoff part shown in FIG. 1.

The flow cutoff part 50, as shown in FIG. 4, includes a body 51, a rib 52, a fixing portion 53, a tilted portion 54 and a support portion 55.

The body 51 is configured to have a panel shape to adhere closely to the inner lateral side of the door 30 corresponding to the contact area between the door 30 and the outer boundary of the opening of the storage room 12. In the present embodiment, the body 51 is configured to have a panel shape corresponding to a shape of an outer side of the dike 32 extending in a vertical direction, so that the body 51 can adhere closely to the outer side of the dike 32 projected from the inner edge of the door 30.

In a two-door type refrigerator having a pair of the doors 30 provided to right and left parts, respectively, the body 51 is provided to each of the right and left doors 30 to be attached with the dike projected from the inner lateral side of the corresponding door.

Preferably, the body 51 comes into adhering closely to the outer lateral side of the dike 32 by a fixation of the fixing portion 53. Preferably, the body 51 is formed of a hard resin to enable a locking of the rib 52.

Figure 5:
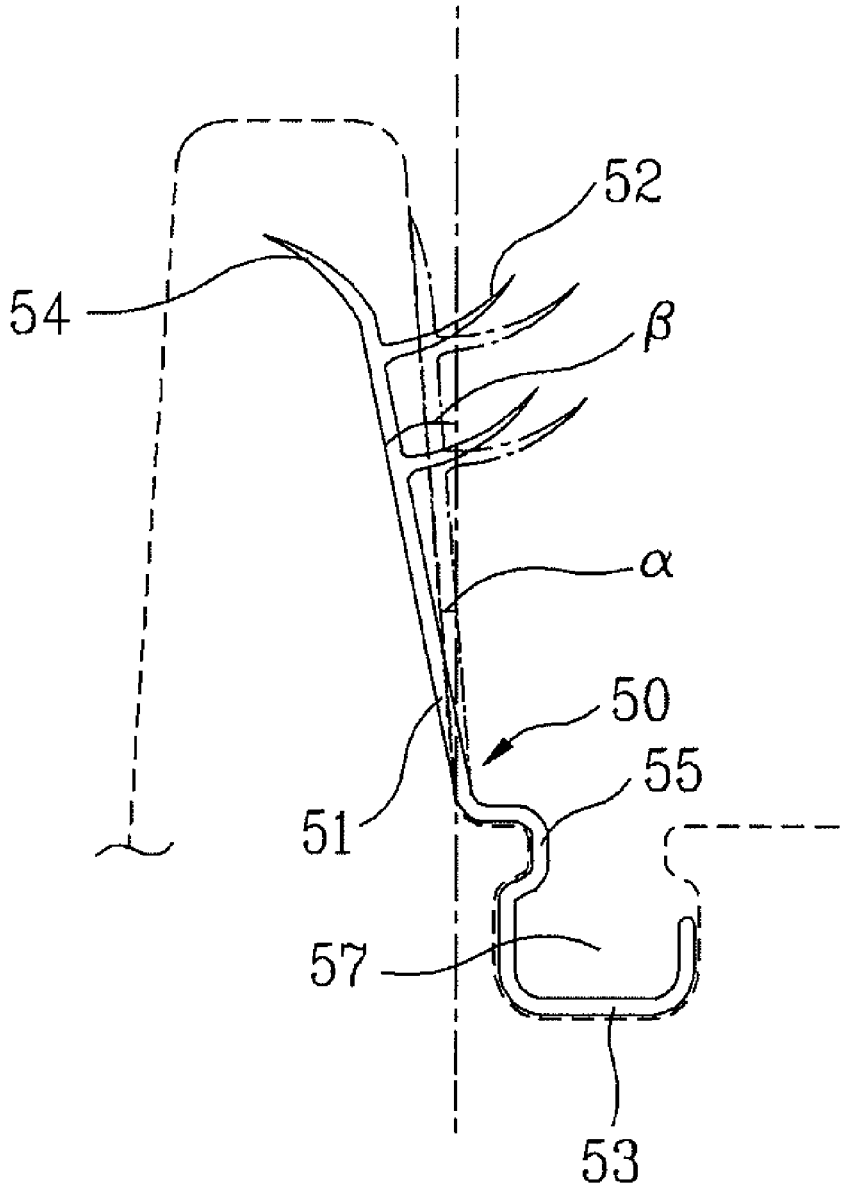
FIG. 5 is a cross-sectional diagram of the flow cutoff part shown in FIG. 4.

The rib 52, as shown in FIG. 5, is configured to have a panel shape projected from the outer lateral side of the body 51 that adheres closely to the outer lateral side of the dike 32.

If the door 30 is closed to block a front side of the corresponding storage room 12, the above-configured rib 52 can cut off the cold air flowing toward the contact area between the inner side of the door 30 and the front side of the barrier 20.

Preferably, the rib 51 is configured to have a prescribed curvature to enable a flowing direction of the cold air to be changed to a direction of the storage room 12 inside the door 30. Preferably, the rib 52 is configured to be bent concave in the direction of the storage room 12. Besides, to cut off the cold air more efficiently, the rib 52 can be configured to be tilted at a prescribed angle from the body 51 in the direction of the storage room 12.

The rib 52 is projected from the body 51 attached to the dike 32 of the door 30 towards the barrier 20 contacting with the door 30. To prevent noise and friction generated from a front end portion of the rib 52 coming into contact with the barrier 20, it is preferable that the rib 52 is configured to extend towards the barrier 20 from the body 51, but to be spaced apart from the barrier 20.

Preferably, the flow cutoff part comprises a plurality of such rib members 52 arranged in the flowing direction of the cold air to be spaced apart from each other to multiply cut off the cold air flowing toward the contact area between the inner lateral side of the door 30 and the front side of the barrier 20.

In the present embodiment, a pair of the ribs 52, as shown in FIG. 3 and FIG. 4, are arranged to be spaced apart from each other.

Meanwhile, it is preferable that the rib 52 is built in one piece with the body 51. Preferably, the rib 52 is formed of a soft resin to enable a user to avoid a feeling of heterogeneity in contacting with the rib 52.

The fixing portion 53 includes a bent panel provided to an end of the body to have a shape corresponding to the fixing groove 33 provided to the inner lateral side of the door 30. And, the fixing portion 53 is fitted into the fixing groove 33.

An insertion groove 57 is provided to the fixing portion 53 to have one open side so that the sealing part 40 can be fitted into the insertion groove 57 again while being fitted into the fixing groove 33. In particular, the fixing protrusion 41 of the sealing part 40 is fitted into the insertion groove 57 while the fixing portion 53 is fitted into the fixing groove 33, whereby the sealing part 40 can be assembled to the edge of the inner lateral side of the door 30.

In the present embodiment, an auxiliary sealing part 42, as shown in FIG. 3, is further provided to one side of the sealing part 40. The auxiliary sealing part 42 is configured in a manner that the sealing part 40 extends from a lateral direction from one side end of the sealing part 40. In the present embodiment, the auxiliary sealing part 42 is configured to extend from one side of the sealing part 40 in a direction of the dike 32 and to contact with the outer lateral side of the dike 32.

The auxiliary sealing part 42 is configured to have a hollow tube shape similar to the shape of the sealing part 40. Preferably, the auxiliary sealing part 42 is built in one piece with the sealing part 40.

The tilted portion 54 of the rib 52 is configured to be curved from the other side end of the body 51 in the direction of the inner lateral side of the door 30, and more specifically, in a direction of a face contacting with the dike 32.

Preferably, the tilted portion 54 is formed of a soft resin based material to enable the body 51 to adhere closely to the outer lateral side of the dike 32 while facilitated to be pressed.

The support part 55 is configured to have a shape corresponding to a hanging sill 34 provided at an entrance to the fixing groove 33. The support part 55 plays a role in improving a fixing force while the body 51 is fixed to the fixing groove 33.

Preferably, the body 51 of the flow cutoff part 50, as shown in FIG. 5, is further tilted in the direction of the inner later side of the door 30 to be pressurized toward the inner lateral side of the door 30. So, as the fixing portion 53 comes into adhering closely to an inner circumference of the fixing groove 33 to be fixed thereto, the body 51 of the flow cutoff part 50 built in one body of the fixing portion 53 comes into adhering closely to the outer lateral side of the dike 32 provided to the edge of the inner lateral side of the door 30.

In particular, the body 51 is configured to be tilted at an angle ($\alpha$) greater than a tilted angle ($\beta$) of the outer lateral side of the dike 32. So, the body 51 is pressurized by its slope to be fixed to the outer lateral side of the dike 32.

An assembly process of the above-explained flow cutoff part 50 is explained with reference to FIG. 6 as follows.

FIG. 6 is a cross-sectional diagram of a flow cutoff part and a door for explaining a process of assembling the flow cutoff part to the door.

Referring to FIG. 6, an assembly of the flow cutoff part 50 according to the present invention is carried out in a manner of inserting the fixing portion 53 of the flow cutoff part 50 into the fixing groove 33 recessed into the edge of the inner lateral side of the door 30.

Meanwhile, a width of the fixing portion 53 is configured similar to that of the fixing groove 33 to enable the fixing portion 53 to adhere closely to the inner circumference of the fixing groove 33. And, the hanging sill 34 is projected from each side end of the entrance of the fixing groove 33. So, it is difficult to directly inset the fixing portion 53 into the entrance of the fixing groove 33.

So, the fixing portion 53, as shown in FIG. 6, is inserted into the fixing groove 33 is a following manner.

First of all, the body 51 of the flow cutoff part 50 is laid parallel to the inner lateral side of the door 30 to make the open portion of one side of the fixing portion face a direction of the entrance of the fixing groove 33. A front end of the fixing portion 53 is inserted in the entrance of the fixing groove 33. The fixing portion 53 and the body 51, as shown in FIG. 6, are turned by about 90? within the fixing groove 33 in sequence. The fixing portion 53 is then inserted into the fixing groove 33.

As the fixing portion 53 is configured to have the shape corresponding to that of the inner circumference of the fixing groove 33, the fixing portion 53 is fitted into the fixing groove 33 to adhere closely to the inner circumference of the fixing groove 33.

When the fixing portion 53 adheres closely to the inner circumference of the fixing groove 33 to be fixed thereto, the body 51 of the flow cutoff part 50 built in one body of the fixing portion 53 comes into adhering closely to the outer lateral side of the dike 32 provided to the edge of the inner lateral side of the door 30.

As the body 51 is attached to the outer lateral side of the dike 32, the rib 52 projected from the body 51 are arranged in a direction of the barrier 20 coming into contact with the door 30 that is closing.

Simultaneously, as the body 51 is attached to the outer lateral side of the dike 32, the tilted portion 54 provided to the front end of the body 51 is attached to the outer lateral side of the dike 32.

In this case, the tilted portion 54 is configured to be curved from the front end of the body 51 toward the dike 32. So, when the body 51 comes into contact with the outer lateral side of the dike 32, the curved portion of the tilted portion 54 comes into adhering closely to the outer lateral side of the dike by the contacting force of the body 51.

As the tilted portion 54 is pressed by the outer lateral side of the dike 32, the curved shape of the tilted portion 54 is straightened. So, the tilted portion 54 can pressurize the outer lateral side of the dike 32 with a relatively considerable pressure.

An operation of the flow cutoff part 50 in the above-configured refrigerator is explained as follows.

First of all, after the door 30 has been closed 30, the refrigerator 10 is activated. If so, a portion of cold air within the storage room 12 flows to the contact area between the door 30 and the storage room 12, and more particularly, to the sealing part 40.

The cold air having flowed to the contact area between the door 30 and the front side of the storage room 12 is cut off by the flow cutoff part 50 provided to the edge of the inner lateral side of the door 30 not to flow farther. In the present embodiment, the flow cutoff part 50 provided to one end opposite to the hinge of the door 30 of the refrigerator 10 cuts off the cold air flowing toward the contact area between one end of the door 30 and the barrier 20.

The cold air flowing toward the contact area between the inner lateral side of the door 30 and the front side of the barrier 20 within the storage room 12 moves away into a space between the dike 32 provided to one end opposite to the hinge at the inner lateral side of the door 30 and one inner lateral side of the barrier 20.

The cold air having moved to the space between the outer lateral side of the dike 32 and one lateral side of the barrier 20 is interrupted by the rib 52 projected between the dike 32 and the barrier 20.

Since the rib 52 is configured concave in the direction of the storage room 12, a flowing direction of the cold air contacting with the rib 52 is changed to flow in the direction of the storage room 12 according to the shape of the rib 52. So, it is able to prevent the cold air, which is interrupted by the rib 52 to stay on the contact area, from generating turbulence. And, it is also able to prevent the cold air from moving to the contact area by being pushed by a following cold air behind the interrupted cold air.

In case that the rib 52 is configured to be tilted by a prescribed angle from the body 51 of the flow cutoff part 50 in the direction of the storage room 12, the flowing direction of the cold air introduced into the rib 52 is changed to prevent the cold air from flowing into the space between the door 30 and the barrier 20.

In this case, the cold air flowing from the storage room 12 into the space between the door 30 and the barrier 20 may be introduced into the area between the dike 32 and the front end of the body 51 of the flow cutoff part 50. Yet, since the tilted portion 54 formed at the front end of the body 51 adheres to the dike 32 closely and firmly, it is able to prevent a gap from being generated between the front end of the body 51 and the dike 32. Hence, the cold air is prevented from being introduced into the space between the body 51 and the dike 32.

Besides, since the cold air or particles are prevented from being introduced through the space between the dike 32 and the barrier 20, it is able to prevent food residue or beverage to be stored in the storage room 12 of the refrigerator 10 from being introduced into the space between the dike 32 and the barrier 20. Hence, it is able to keep the refrigerator clean.

Meanwhile, a plurality of the rib 52 are provided to be arranged in the flowing direction of the cold air. So, a movement of the cold air flowing toward the sealing part 40 is primarily cut off by the rib 52 projected in the vicinity of the front end of the body 51, i.e., the tilted portion 54. And, the cold air, which is introduced into the space between the door 30 and the barrier 20 by avoiding being interrupted by the rib in the vicinity of the tilted portion 54, is secondarily blocked by the other rib projected in the vicinity of a tip of the body 51, i.e., the fixing portion 53.

Moreover, as the rib 52 is projected to be spaced apart from one lateral side of the barrier 20, it is able to prevent the friction between the front end of the rib 52 and the barrier 20. Hence, the front of the rib 52 can be prevented from being broken or generating noise.

Hence, by preventing the cold air within the storage room 12 of the refrigerator 10 from flowing to the contact area between the door 30 closing the front opening of the storage room 12 and the front side edge of the storage room 12 or the barrier 20, it is able to prevent the cold air from leaking outside via the gap of the contact area between the door 30 and the front side of the storage room 12.

As the tilted portion 54 of the flow cutoff part 50 provides strong adherence to the edge of the inner lateral side of the door 30 or the dike 32, it is able to prevent the cold air and particles from being introduced into the gap between the body 51 of the flow cutoff part 50 and the inner lateral side of the door 30 or the dike 32.

A refrigerator according to a second embodiment of the present invention is explained with reference to FIG. 7 and FIG. 8 as follows.

FIG. 7 is a cross-sectional diagram of a door and a flow cutoff part of a refrigerator according to a second embodiment of the present invention, in which a fixed state of the door and flow cutoff part is shown, and FIG. 8 is a perspective diagram of a door according to a second embodiment of the present invention.

Referring to FIG. 7 and FIG. 8, a basic configuration of a refrigerator according to a second embodiment of the present invention is identical to that of the refrigerator according the first embodiment of the present invention. A flow cutoff part 50 of a refrigerator according to the second embodiment of the present invention includes a first body 51, a rib 52, a fixing portion 53, a support portion and a tilted portion 54. Yet, in the second embodiment of the present invention, a recessed portion 60 is provided to an inner lateral side of the door 30 to accommodate the flow cutoff part 50.

The recessed portion 60 is recessed into the dike 32 so that an outer lateral side of the dike 32 contacting with the body 51 of the sealing member 50 can have a shape identical to that of the body 51 of the of the sealing member 50 or can be greater than the body 51 of the sealing member 50.

Meanwhile, the recessed portion 60 is recessed to have a panel shape extending long in a length direction of the refrigerator like to the shape of the body 51. And, it is preferable that a recessed thickness of the recessed portion 60 is equal to or slightly greater than a thickness of the body 51.

And, the recessed portion 60 is formed in a manner that the tip of the body 51 and the fixing hook 53, as shown in FIG. 7, are directly connected to the inner lateral side of the fixing groove 33 from the outer lateral side of the dike 32.

As mentioned in the foregoing description, as the present embodiment provides the recessed portion accommodating the flow cutoff part 50, the flow cutoff part 50 can be completely inserted into the inner lateral side of the door 30. So, it is able to prevent the outer lateral side of the body 51 from being externally projected and to firmly fix the flow cutoff part 50.

In the present embodiment, the flow cutoff part 50 is provided to the inner lateral side of the door 30. Alternatively, in case that the flow cutoff part 50 is provided to the inner lateral side of the storage room 12, the recessed portion 60 is provided to the inner lateral side of the storage room 12.

A refrigerator according to a third embodiment of the present invention is explained with reference to FIG. 9 and FIG. 10 as follows.

Figure 9:
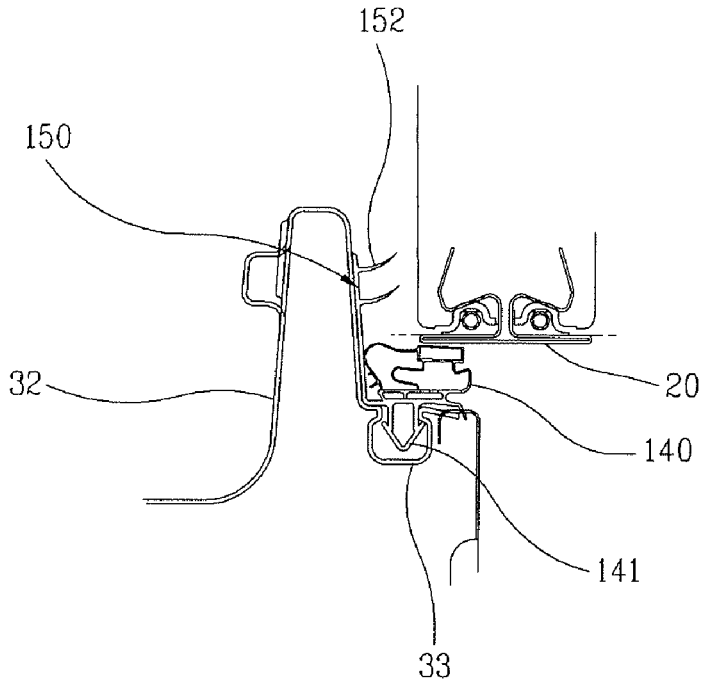
FIG. 9 is a cross-sectional diagram of a contact area of a door of a refrigerator according to a third embodiment of the present invention, in which the door is closed.
Figure 10:
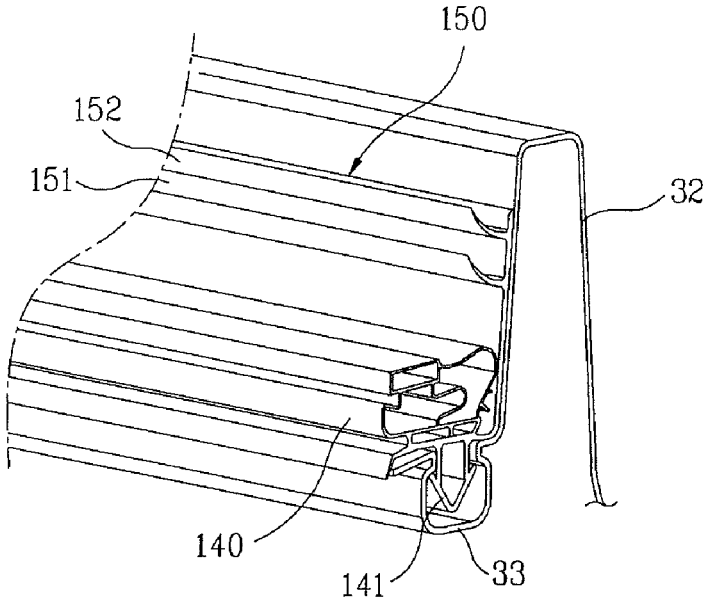
FIG. 10 is a perspective diagram of the door shown in FIG. 9.

FIG. 9 is a cross-sectional diagram of a contact area of a door of a refrigerator according to a third embodiment of the present invention, in which the door is closed, and FIG. 10 is a perspective diagram of the door shown in FIG. 9.

Referring to FIG. 9 and FIG. 10, a refrigerator according to a third embodiment of the present invention includes a refrigerator body 10, a door 30, a sealing part 140 and a flow cutoff part 150 like the first or second embodiment of the present invention. Yet, in the third embodiment of the present invention, the sealing part 40 and the flow cutoff part 150 are built in one body.

So, the flow cutoff part 150 does not need a separate fixing portion. The flow cutoff part 150 extends from an upper part of a fixing protrusion 141 in an outer direction. The flow cutoff part 150 is configured to be bent along an inner lateral side of the door 30. And, the flow cutoff part 150 includes a rib 152 that is externally projected.

Hence, in the third embodiment of the present invention, by fitting the fixing protrusion 141 formed at the sealing part 140 into the fixing groove 33 formed on the inner lateral side of the door 30, the flow cutoff part 150 built in one body of the sealing part 140 can be assembled easily.

A refrigerator according to a fourth embodiment of the present invention is explained with reference to FIG. 11 as follows.

Figure 11:
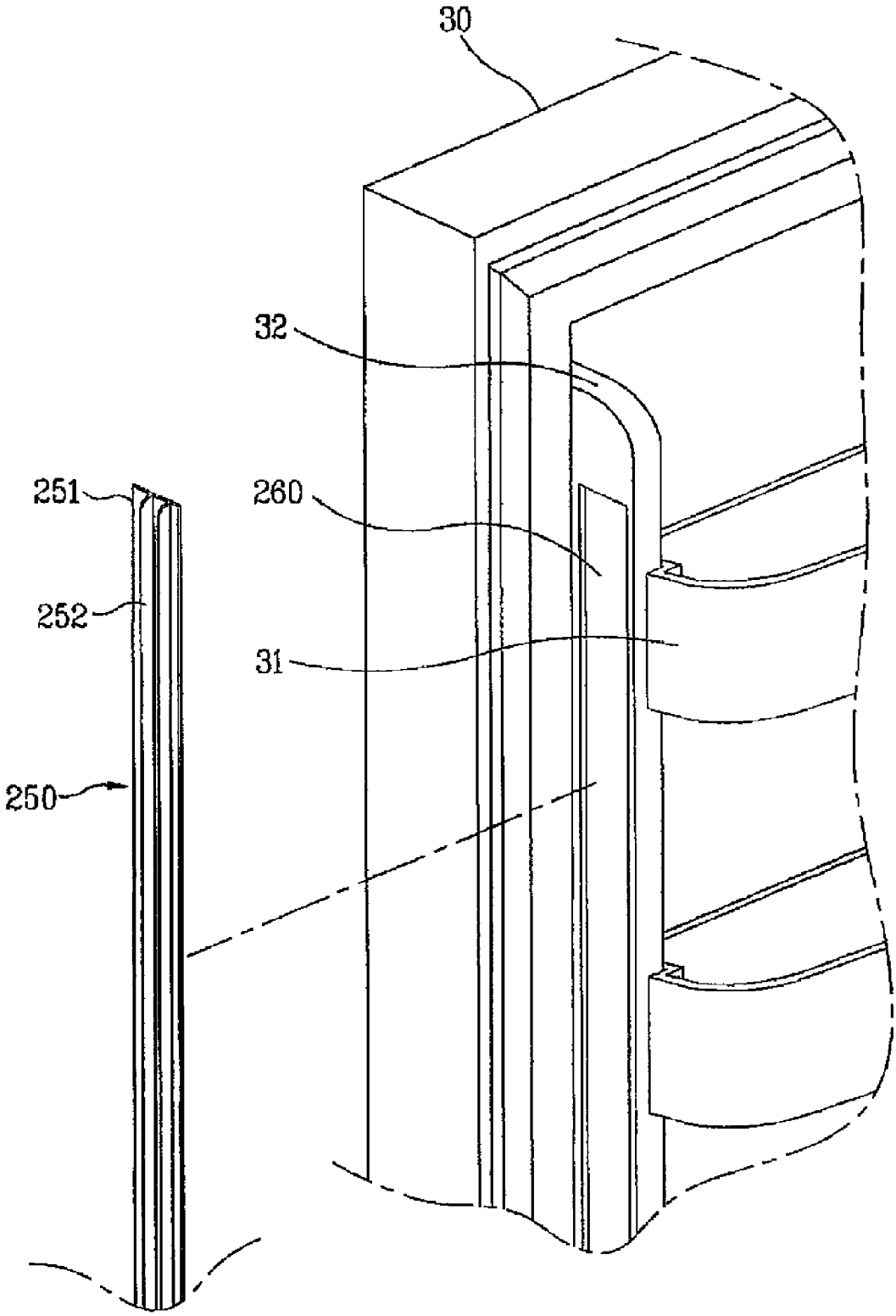
FIG. 11 is an exploded perspective diagram of a door of a refrigerator according to a fourth embodiment of the present invention.

FIG. 11 is an exploded perspective diagram of a door of a refrigerator according to a fourth embodiment of the present invention.

Referring to FIG. 11, unlike the former embodiments, a flow cutoff part 250 of a refrigerator according to a fourth embodiment of the present invention is attached to the inner lateral side of the door 30 by a prescribed adhesive agent.

In particular, the flow cutoff part 250 is attached to the inner lateral side of the door 30, and more particularly, to the dike 32 instead of fitting one end of the flow cutoff part 250 into the fixing groove provided to the inner lateral side of the door 30.

Meanwhile, a recessed portion 260 is recessed into the dike 32 to accommodate the flow cutoff part 250 like the second embodiment of the present invention.

Hence, the flow cutoff part 250 can be completely inserted into the inner lateral side of the door 30. So, it is able to prevent the outer lateral side of the body 251 from being externally projected and to firmly fix the flow cutoff part 250.

In the fourth embodiment of the present invention, the flow cutoff part 250 includes the body 251 and a rib 252. Alternatively, by providing the fixing portion of the former embodiments, the flow cutoff part 250 can be fixed to the fixing groove 33 provided to the inner lateral side of the door 30. So, it is able to raise a fixing force of the flow cutoff part 250 together with the fixing force of adhesion.

Besides, the sealing part (not shown in the drawing) is fitted into the fixing groove 33 provided to the inner lateral side of the door 30.

A refrigerator according to a fifth embodiment of the present invention is explained with reference to FIG. 12 as follows.

Figure 12:
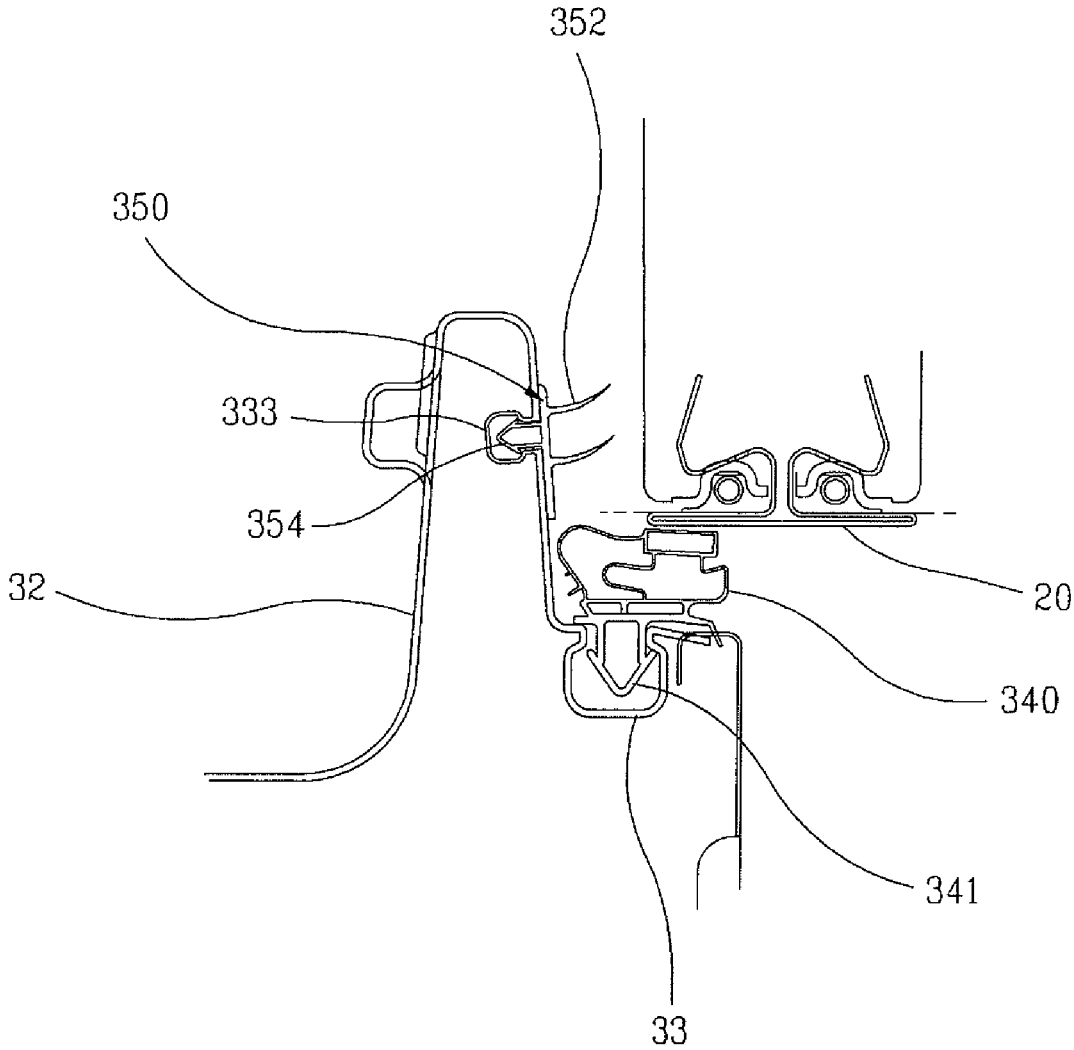
FIG. 12 is a cross-sectional diagram of a contact area of a door of a refrigerator according to a fifth embodiment of the present invention.

FIG. 12 is a cross-sectional diagram of a contact area of a door of a refrigerator according to a fifth embodiment of the present invention.

Referring to FIG. 12, a sealing part 340, like the third embodiment of the present invention, is fixed in a manner that a fixing protrusion 341 is inserted into the fixing groove 33 provided to the inner lateral side of the door 30.

Yet, in the fifth embodiment of the present invention, the sealing part 340 is configured as a member separate from a flow fixing part 350. The flow cutoff part 350 is detachably provided to the inner lateral side of the door 30, and more particularly, to the dike 32.

For this, a second fixing groove 333 is additionally provided to the inner lateral side of the door 30 to fix the flow cutoff part 350 thereto. And, a second fixing protrusion 354 is provided to a backside of a surface, from which a rib 353 is projected from the flow cutoff part 350, to be fitted into the second fixing groove 333.

Hence, the flow cutoff part 350 is facilitated to be fixed in a manner of fitting the second fixing protrusion 354 into the second fixing groove 333.

Optionally, like the fourth embodiment of the present invention, by providing a recessed portion to accommodate the flow cutoff part, it is able to prevent the body of the flow cutoff part 350 from being externally projected and to fix the flow cutoff part 350 more firmly.

Optionally, by coating an adhesive agent between a backside of the flow cutoff part 350 and the inner lateral side of the door 30, it is able to raise a fixing force of the flow cutoff part 350.

While the present invention has been described and illustrated herein with reference to the preferred embodiments thereof, it will be apparent to those skilled in the art that various modifications and variations can be made therein without departing from the scope of the invention. Thus, it is intended that the present invention covers the modifications and variations of this invention that come within the scope of the appended claims and their equivalents.

INDUSTRIAL APPLICABILITY

By providing the flow cutoff part for cutting off the cold air flowing toward the sealing part from the storage room, it is able to cut off the cold air leakage more effectively together with the sealing part.

The invention claimed is:

1. A refrigerator comprising:

a refrigerator body having an opening, and a storage room provided therein;

a door closing/opening the opening;

a sealing part provided to at least one of the door and the refrigerator body to prevent cold air from leaking out of the storage room; and a flow cutoff part provided inwards from the sealing part to further prevent the cold air from leaking by blocking at least some of the cold air flowing toward the sealing part from the storage room, wherein the flow cutoff part includes at least one rib projected outwardly towards an inner lateral side of the storage room, a tip of the rib is spaced apart from the inner lateral side of the storage room, and the at least one rib is configured concave toward the storage room with a prescribed curvature, wherein the flow cutoff part further comprises a fixing portion having a shape corresponding to, and adapted for fitting into, a fixing groove provided to an inner lateral side of the door, and wherein an insertion groove is formed by the fixing portion having one open side to enable the sealing part to be fitted into the insertion groove while the fixing portion is fitted into the fixing groove.

2. The refrigerator of claim 1, wherein the at least one rib extends long in a length direction.

3. The refrigerator of claim 1, wherein the at least one rib comprises a plurality of rib members arranged to be spaced apart from each other.

4. The refrigerator of claim 1, wherein the flow cutoff part is detachably provided to an inner lateral side of an door.

5. The refrigerator of claim 1, wherein the flow cutoff part is provided to an inner lateral side of an door.

6. The refrigerator of claim 1, the sealing part comprising a fixing protrusion to be fitted into the insertion groove provided to the flow cutoff part.

7. The refrigerator of claim 1, the flow cutoff part further comprising a support portion having a shape corresponding to a hanging sill provided to an entrance side of the fixing groove.

8. The refrigerator of claim 1, the flow cutoff part further comprising a tilted portion provided to a tip of the flow cutoff part to be tilted in a direction opposite to a direction that the rib is projected.

9. The refrigerator of claim 4, wherein a body of the flow cutoff part provided with at least one rib is tilted toward the inner lateral side of the door such that it is pressed against the inner lateral side of the door when fitted.

10. The refrigerator of claim 1, wherein a recessed portion is provided to at least one of the inner lateral side of the door and the inner lateral side of the storage room to accommodate the flow cutoff part.

11. The refrigerator of claim 1, wherein the sealing part and the flow cutoff part are built in one body.

12. The refrigerator of claim 1, wherein the flow cutoff part is attached to the inner lateral side of the door by a prescribed adhesive agent.

* * * * *